US006817221B1

(12) United States Patent
Cale

(10) Patent No.: US 6,817,221 B1
(45) Date of Patent: Nov. 16, 2004

(54) WOUND REGENERATOR METHOD

(75) Inventor: E. Todd Cale, Coolville, OH (US)

(73) Assignee: Sunpower, Inc., Athens, OH (US)

( * ) Notice: Subject to any disclaimer, the term of this patent is extended or adjusted under 35 U.S.C. 154(b) by 0 days.

(21) Appl. No.: 10/627,363

(22) Filed: Jul. 25, 2003

(51) Int. Cl.[7] ..... B21D 53/04
(52) U.S. Cl. ..... 72/147; 29/890.039
(58) Field of Search ..... 72/147, 187, 196; 29/890.039

(56) References Cited

U.S. PATENT DOCUMENTS 1,349,444 A * 8/1920 Sundi ..... 72/147
2,257,760 A * 10/1941 Nyberg ..... 72/147
3,581,389 A * 6/1971 Mori et al. ..... 29/598
4,061,183 A * 12/1977 Davis ..... 165/8
4,160,371 A * 7/1979 Wilkening et al. ..... 72/147

* cited by examiner

*Primary Examiner*—Lowell A. Larson
(74) *Attorney, Agent, or Firm*—Jason H. Foster; Kremblas, Foster, Phillips & Pollick

(57) ABSTRACT

A method of forming a wound roll, such as a regenerator, including the steps of inserting wires at the lateral edges of an elongated strip as the strip is being wound around a spool. Spacers, such as localized bumps, are formed on the strip to space strip layers apart to form uniform gaps. An offset is added to the angle of rotation between each spacer-forming step to inhibit the nesting of bumps in the cavities of adjacent strip layers.

15 Claims, 3 Drawing Sheets

WOUND REGENERATOR METHOD

BACKGROUND OF THE INVENTION

1. Field of the Invention

This invention relates generally to thermal regenerators and more particularly to a method of forming a thermal regenerator from a thin strip of material having sufficient thermal conductivity to form the heat transfer surfaces of the regenerator, and also having spacers on the strip that neither nest nor are compressed.

2. Description of the Related Art

Many devices, Stirling cycle machines in particular, include a thermal regenerator to which thermal energy is transferred from a flowing fluid, and from which thermal energy is transferred to the fluid. Regenerators are normally made with large surface area structures, such as wool, foil or spheres, and are made of metal, such as stainless steel, or another suitable material that absorbs thermal energy but does not conduct it especially well.

In a Stirling cycle engine, for example, a working gas is moved between a warmer space and a cooler space by a reciprocating displacer to drive a reciprocating piston. The gas is heated during one part of the cycle, and cooled During another part. When the warm gas is being transported from the warmer space, it flows through a regenerator, and thermal energy is transferred to the regenerator by convection, i.e., the impingement of heated gas molecules on the regenerator's surfaces. The regenerator is warmed and the gas is cooled when thermal energy is transferred to the regenerator as the gas flows through the regenerator to the cooler space.

Once the gas has been cooled in the cooler space, it is driven again through the regenerator; ordinarily in the opposite direction as when the gas was driven from the warmer space. The cooler gas flowing through the regenerator is warmed by the same convection mechanism by which the gas warmed the regenerator: impingement of gas molecules on the regenerator's surfaces. Regenerators therefore improve the efficiency of the Stirling cycle engine because the gas enters the heated end pre-warmed, and gas enters the cooler end pre-cooled. Of course, regenerators improve the efficiency of many machines other than Stirling cycle machines.

In conventional regenerators, there must be a substantial amount of contact between the flowing fluid molecules and the surfaces of the regenerator in order for substantial heat transfer to occur. One type of regenerator used in Stirling cycle machines uses a long thin strip of metal, such as stainless steel, that is wound up in a roll and placed in a chamber through which gas flows longitudinally of the roll. Each "layer" of the metal has a space or gap between it and the next adjacent "layer" for fluid to pass through.

It is desirable to have uniform spacing of the layers of such a wound regenerator, but it is often difficult, in practice, to achieve such uniformity of spacing. Localized deformations, such as "bumps", can be formed on the strip of metal that is subsequently wound to form a regenerator. These bumps, each of which has a corresponding cavity on the opposite side of the strip, can accurately and inexpensively space one wound "layer" of the strip from another, in order to promote uniform gas flow through the regenerator.

In conventional methods for making wound regenerators, the bumps can be compressed and crushed if the strip is wound too tightly onto a spool structure. Additionally, bumps of one layer may nest within cavities formed on an adjacent layer of the strip, thereby defeating, at least partially, the advantageous effect of the bumps.

Non-uniform gaps result in high fluid flow rates through larger gaps, and low flow rates through smaller gaps. Non-uniform flow is disadvantageous, because large gaps permit some gas flowing through the regenerator to make poor contact with the surfaces with which thermal transfer should take place, and small gaps restrict the flow of gas therethrough. Furthermore, the pressure drop that is critical to the class of machines referred to as free-piston machines is often compromised with conventional regenerators, thereby resulting in unanticipated dynamic motion of the moving parts.

There is therefore a need for a method of making a wound regenerator that maintains substantially uniform spacing of the layers of a wound regenerator throughout the entire region of the regenerator through which fluid flows.

BRIEF SUMMARY OF THE INVENTION

The invention is a method of producing a wound roll, such as a regenerator, from an elongated strip. The method comprises forming a plurality of spacers on the strip by deforming the strip in a plurality of discrete locations along the strip's length. Another step of the method includes positioning elongated wires on the strip near opposing lateral strip edges. A further step includes winding the strip and the wires around a rotating take-up spool, thereby forming strip layers where portions of the strip are wound over previously wound portions of the strip with wires interposed between adjacent layers of the strip. The wires are removed from the wound strip, such as by pulling them from between the strip layers. Preferably, the wires have a diameter substantially equal to a spacer height, and the spacers of each strip layer seat against an adjacent strip layer, thereby spacing the layers from one another and leaving uniform thickness gaps extending entirely through the regenerator.

In an alternative embodiment, the method comprises extending the elongated strip through a forming tool and winding the elongated strip around a rotatable take-up spool downstream of the forming tool. Furthermore, the method includes rotating the take-up spool through a predetermined angle that is a fraction of a complete rotation of the take-up spool, thereby advancing the elongated strip through the forming tool a predetermined distance that is a function of the predetermined angle. Next, the take-up spool is stopped and then the forming tool is actuated to deform the strip locally to form at least one spacer on the strip.

The steps of rotating the take-up spool, stopping the spool and actuating the forming tool are repeated until the take-up spool has been rotated about 360 degrees. Once the take-up spool has been rotated about 360 degrees, the take-up spool is rotated through the predetermined angle plus an offset angle to advance the elongated strip through the forming tool a distance that is different from the predetermined distance, such as more or less than the predetermined distance. The take-up spool is then stopped and then the forming tool is actuated to deform the strip locally to form at least one spacer on the strip.

The above steps of advancing the take-up spool, stopping and actuating the forming tools are repeated for a plurality of complete rotations of the take-up spool. The process forms layers of the elongated strip where a portion of the elongated strip is wound around the take-up spool over a previously wound portion of the elongated strip. The offset angle is added to the predetermined angle in order to offset the spacers that are formed in adjacent layers, thus inhibiting alignment of spacers on adjacent layers.

In one embodiment, the method described immediately above also includes positioning at least one elongated wire on the strip upstream of the take-up spool and then winding the strip and said at least one wire around the take-up spool with said at least one wire interposed between adjacent layers of the strip. Subsequently, the wire is removed.

The spacers can be bumps formed in the strip by plastically deforming the strip, such as by forcing the foil into a recess with a molded tool, thereby stretching the foil locally. The tips of each of the bumps seat against the next adjacent layer of the strip, thereby spacing each layer uniformly from the next adjacent layer. The spacers can be tabs.

Figure 1:
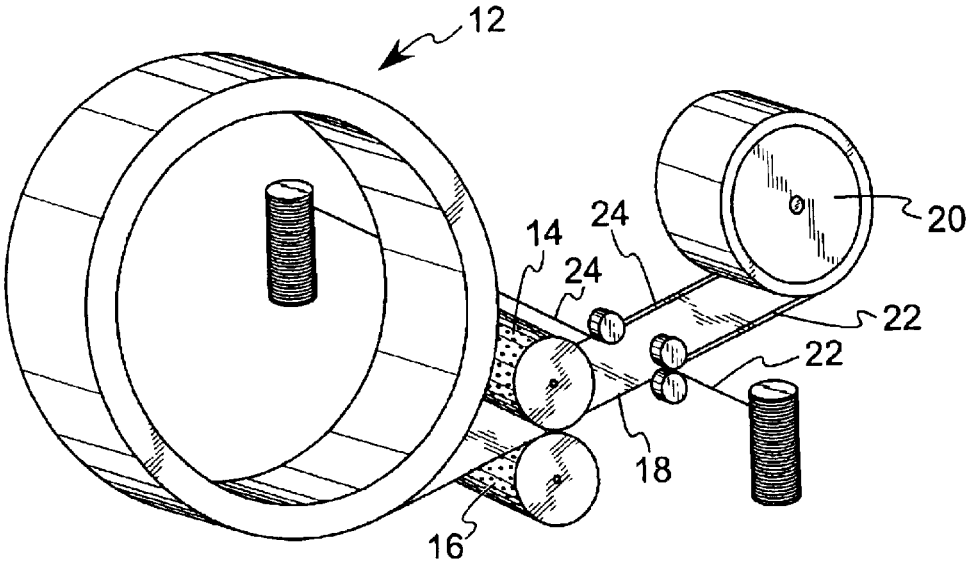
FIG. 1 is a schematic view in perspective illustrating the preferred mechanism for practicing the present invention.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or term similar thereto are often used. They are not limited to direct connection, but include connection through other elements where such connection is recognized as being equivalent by those skilled in the art.

DETAILED DESCRIPTION OF THE INVENTION

The preferred structure with which the present invention is practiced is shown in FIG. 1. An elongated strip, preferably made of stainless steel or another acceptable material, is in a wound roll 12 rotatably mounted to a frame structure (not shown). A portion 18 of the strip extends from the roll 12 to a pair of rollers 14 and 16. The rollers 14 and 16 are rotatably mounted to the frame structure (not shown), and a small gap is formed between their respective peripheral, cylindrical surfaces where the rollers 14 and 16 are closest to one another. The thickness of the gap between the rollers 14 and 16 is preferably the same as, or slightly thinner than, the thickness of the strip portion 18, which extends through the gap.

Figure 2:
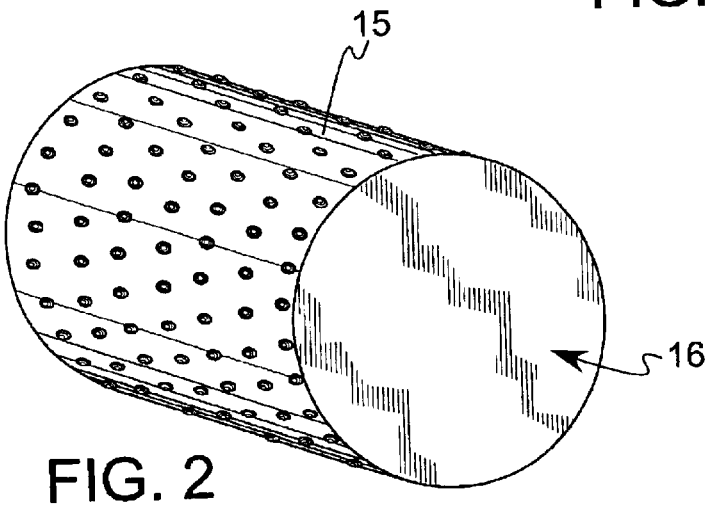
FIG. 2 is a view in perspective illustrating a textured roller.

As shown in FIG. 2, the roller 16 has a textured, peripheral surface 15. In a preferred embodiment, the texture on the surface 15 is made of a plurality of raised bumps, and the peripheral, cylindrical surface of the roller 14 has corresponding concavities, or is made of an elastic material, such as rubber or the like. The surface 15 seats against the upper surface of the strip portion 18, and the peripheral surface of the roller 14 seats against the underside of the strip portion 18. The strip portion 18 extending through the gap in the rollers 14 and 16 is thus pulled from the roll 12 by the driven rollers 14 and 16.

Figure 3:
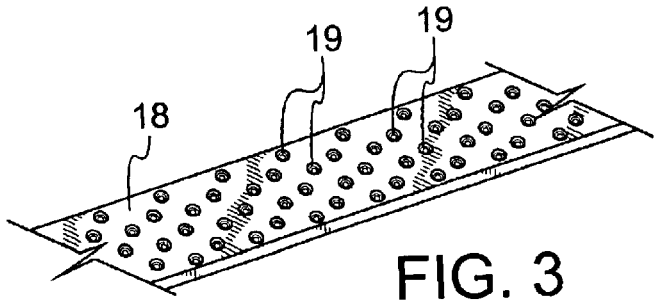
FIG. 3 is a view in perspective illustrating the strip of the present invention with bumps formed on its surface.

The rollers 14 and 16 exert significant compressive forces on the opposite sides of the strip portion 18 as the strip portion 18 passes between the rollers. The forces applied by the rollers 14 and 16 to the strip portion 18 cause the bumps on the surface 15 of the roller 16 to deform the strip portion 18 locally, thereby forming cavities 19 in the strip portion 18 as shown in FIG. 3. The local part of the strip that is displaced to form each cavity on one side of the strip portion 18 is raised up on the opposite side of the strip portion 18 to form bumps having a height substantially equal to the corresponding bump on the roller surface 15. The cavities 19 can be conical, tetrahedral or any other shape as determined by the shape of the bumps on the roller surface 15.

After the bumps are formed, the strip is wound around the take-up spool 20 in a configuration similar to paper wound around a tube, with the exception of a uniform gap that is formed between "layers" of the strip. As the strip is wound around the take-up spool 20, the tops of each of the bumps on the strip portion 18 preferably seat against the underside of the adjacent "layer" of strip that has already been wound around the take-up spool 20. The region of the strip surface between the bumps does not contact the adjacent layer of the strip, because the height of the bumps is significant enough to space this region away from the adjacent layer of the strip. The term "layer" is not ideal, because all "layers" are part of the same elongated strip that is wound multiple times around the take-up spool 20. However, it is understood that each layer refers to each winding of the same elongated strip.

In order to have gaps of consistent size between layers in the finished regenerator, it is necessary that the bumps on the strips retain substantially the same height during and after formation of the bumps. In the manufacture of conventional wound regenerators, there can be a problem with too much torque being applied to a take-up spool, which results in rotation of the take-up spool at an angular displacement that exceeds the linear displacement of the strip. Such a condition results in over-tightening of the strip around the spool, and the spacers are at least partially crushed in some parts of the regenerator when this occurs.

In order to prevent the torque exerted on the take-up spool 20 from over-tightening the wound strip and thereby compressing the bumps, first and second wires 22 and 24 are inserted between the strip portion 18 and the first (and every subsequent) layer of strip that is wound around the take-up spool 20. The wires 22 and 24 are positioned near, and preferably directly adjacent, the lateral edges of the strip portion 18 just before the strip portion 18 is wound around the take-up spool 20. The wires 22 and 24 preferably have a diameter that is substantially equal to the height of the bumps formed in the strip to occupy the gaps between the adjacent layers of the strip.

The wires 22 and 24 maintain the gaps between the layers of the strip 18 on the take-up spool 20 by preventing any excessive torque from over-tightening the strip, which would compress the bumps on the strip as described above. The wires 22 and 24 maintain the gap because they are effectively incompressible, due to the fact that the force required to compress the wires by pulling on the strip is far greater than the force that would easily break the strip before reaching a wire-compressing magnitude. If the wires 22 and 24 cannot be compressed by any over-tightening of the strip, the bumps formed on the strip will not be crushed by excessive tension in the strip.

Once the wires 22 and 24 are inserted and wound between layers of strip on the take-up spool 20, the total number of layers is formed to complete the regenerator and any substantial torque on the take-up spool 20 is released, the wires 22 and 24 are removed. Each wire can be removed by pulling on one end of the wire, or a part of the wire intermediate of the ends, in a direction that is roughly parallel to the axis of the take-up spool 20 and away from the take-up spool 20. This is a lateral direction. After removing the wires 22 and 24, the gaps between the layers of the strip extend completely from one end of the wound regenerator to the other, and the bumps maintain the gaps at a uniform thickness along the entire length of the regenerator.

In an alternative structure in which the invention is practiced, an elongated strip is in a wound roll 112 substantially similar to the roll of the above-described embodiment. The roll 112 is rotatably mounted to a frame (not shown), and a strip portion 118 extends tangentially from the roll 112. The strip portion 118 passes between a forming tool, preferably the pair of cooperating forming tools 114 and 116, and is wound around a take-up spool 120, which is rotatably driven by the stepper motor 130. During operation, the motor 130 rotates the take-up spool 120 to draw the strip from the roll 112, through the forming tools 114 and 116 and winds it onto the take-up spool 120.

Each step of the process by which the strip is formed into a regenerator is described in more detail next. The motor 130 drives the take-up spool 120 a fraction of a complete, 360 degree rotation of the spool 120 and then stops. This short rotation is referred to as a "step" and each step is a rotation of a predetermined angle in a range from a fraction of a degree to many degrees. For example, the motor 130 can rotate the take-up spool 120 a predetermined angle of six degrees, which advances the strip portion 118 a small distance that is a function of that predetermined angle. When the motor 130 stops the rotation of the spool 120, the forming tools operate to create localized spacers in the strip portion 118. The spacers are preferably bumps much like the bumps formed by the rollers 14 and 16.

The forming tools 114 and 116 are driven together to deform the strip portion 118, preferably inelastically, in one or more discrete, local regions of the strip portion 118. The tool 114 has one or more bumps and the tool 116 has corresponding cavities, or is an elastic material such as rubber, which, when driven together with substantial force on opposing sides of the strip portion 118 in the manner of a stamping operation, form one or more spacers, such as bumps, on the strip portion 118.

Thus, one part of the process is the part in which the motor 130 drives the take-up spool 120 and then stops, thereby stopping the advancement of the strip portion 118, and then the tools 114 and 116 are driven together with substantial force to form at least one spacer. Subsequently, the tools 114 and 116 are withdrawn from contact with the strip portion 118, and the motor 130 advances the take-up spool 120 another step, i.e., through the predetermined angle that is a fraction of a complete rotation of the spool 120, and then stops. The tools 114 and 116 are then driven together again to form one or more bumps in the strip portion 118 at a location slightly upstream of the previously formed bumps. Once the tools 114 and 116 withdraw again, the motor 130 advances the take-up spool 120 another step and the cycle repeats over and over again, forming a series of bumps on the strip, and winding the layers of strip on to the take-up spool 120.

In order to avoid, or at least inhibit, the nesting of the bumps of one layer into the cavities of another layer, the invention includes the introduction of an "offset" into each rotation of the take-up spool 120. The offset of the present invention is, in the broad embodiment, an angle that is added to the predetermined angle of each step of the motor 130. This offset angle is preferably a fixed angle, but could be randomly generated in a conventionally known manner, such as by a computer. The offset can range from a fraction of a degree to many degrees.

In an exemplary embodiment, a predetermined angle of the motor 130 is six degrees. Thus, 60 steps at the predetermined angle are required for the take-up spool 120 to complete a full rotation of 360 degrees. The offset can be, for example, two degrees. Under the operation of the invention, during $60^{th}$ step of the motor 130, the offset is added to the predetermined six degree rotation. If the offset is two degrees, then the last step of the first complete rotation will be eight degrees rather than six degrees.

After the step that is made up of the predetermined angle plus the offset is completed, the next 59 steps are six degree steps (the predetermined angle). During the $60^{th}$ step of the second rotation, the offset of two degrees is added to the predetermined angle of six degrees. Thus, the $60^{th}$ step of the second rotation is eight degrees. The next 59 steps are six degree steps, and the $\mathbf{60}^{th}$ step of the third rotation contains the offset added to the predetermined angle. This continues in a cycle until the entire regenerator is completed.

Figure 6:
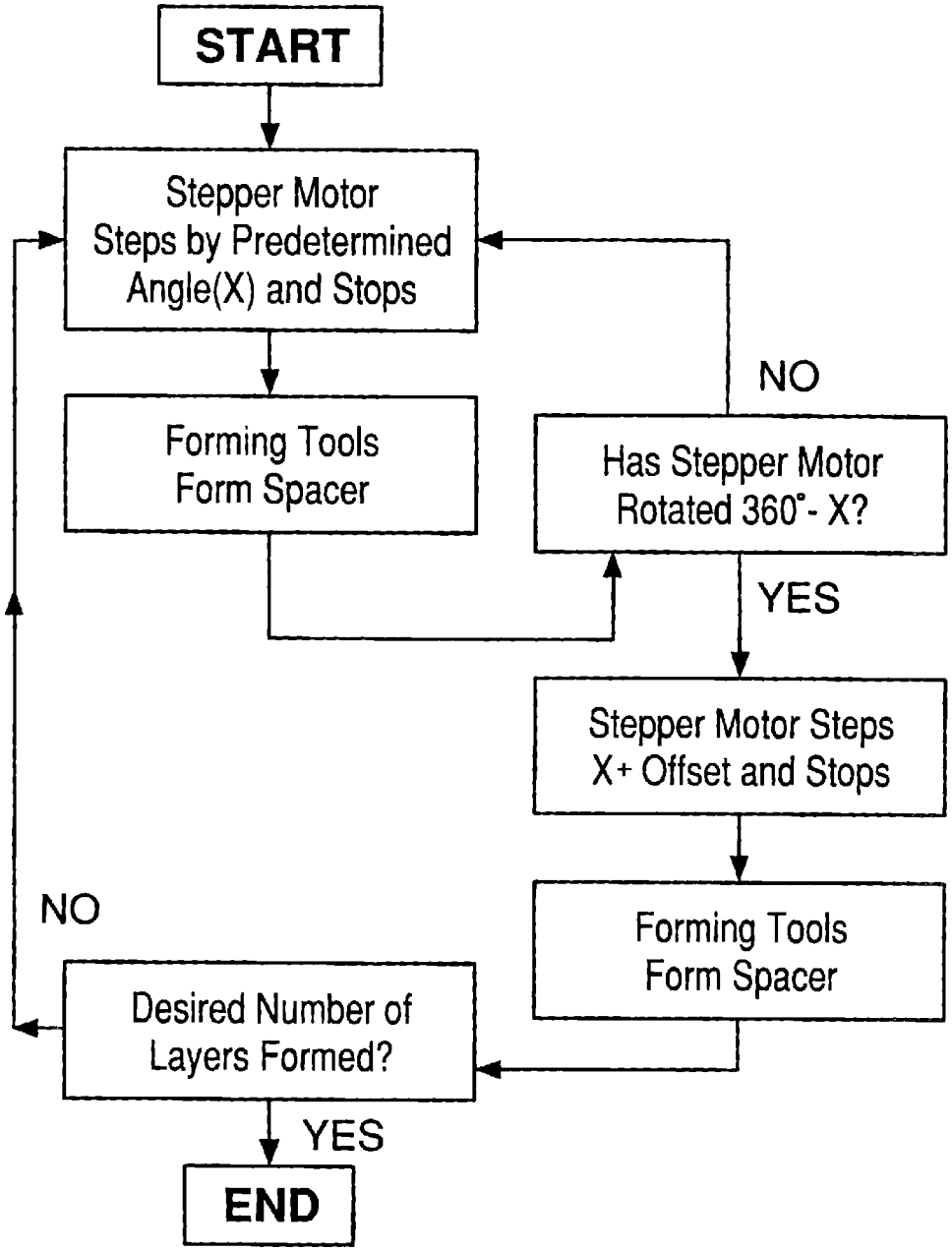
FIG. 6 is a flow chart showing the process of the alternative embodiment.

The process of adding the offset is shown in FIG. 6 as a flowchart in which the START position is the point in time at which the stepper motor is at zero degrees of rotation. The stepper motor steps by the predetermined angle, X, which in the example described above is six degrees, and stops. Next, the forming tools form at least one spacer on the strip. If the stepper motor has not rotated 360 degrees minus the predetermined angle, X, then the process repeats until it has. Once the motor has rotated 360 degrees less the predetermined angle, i.e., at the end of the $59^{th}$ step, the next step of the stepper motor is a step equal to the predetermined angle plus the offset. Subsequently, the motor stops and the forming tools form at least one spacer. If the desired number of layers in the regenerator are not yet formed, the process repeats until they are, at which time the process ends.

By introducing the offset angle, the spacers of one layer are offset physically from the cavities of the underlying layer by the offset amount. Thus, there is essentially no possibility that the bumps of one strip layer will align with the cavities of another strip layer and nest, thereby affecting gap uniformity.

Rather than the offset being a fixed angle, the offset can be randomly chosen, or it can be serially selected from a fixed set of angles that is arranged to provide the approximation of randomness. Alternatively, the particular step of each rotation into which the offset is added can alternatively be chosen randomly. One example of this would be an offset angle of three degrees that is added to one randomly chosen step of each rotation. A person of ordinary skill will recognize from the present description that many alternative offsets, which are too numerous to list here, can be introduced.

Figure 4:
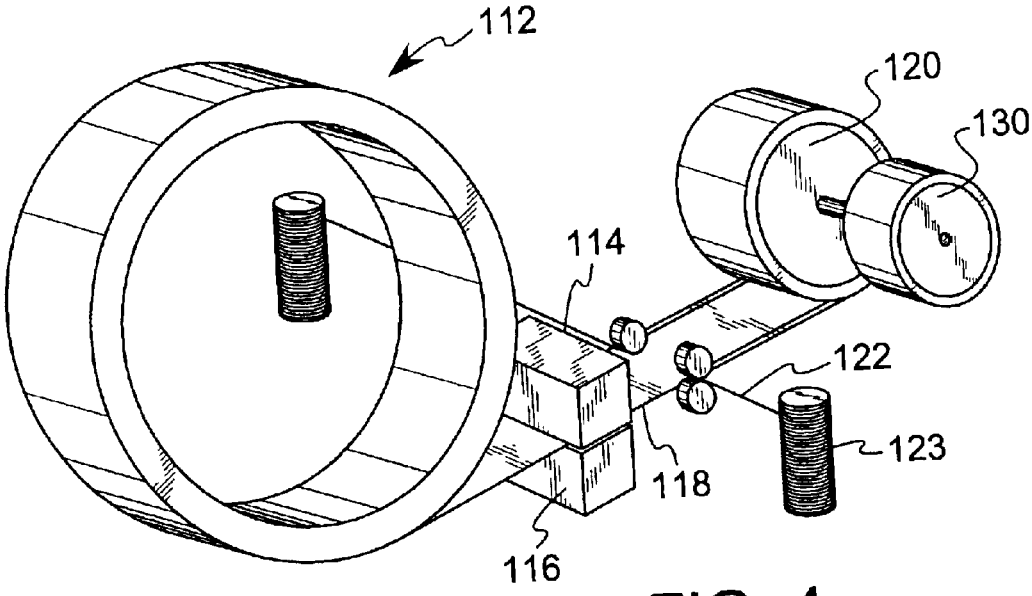
FIG. 4 is a schematic view in perspective illustrating an alternative mechanism for practicing the present invention.
Figure 5:
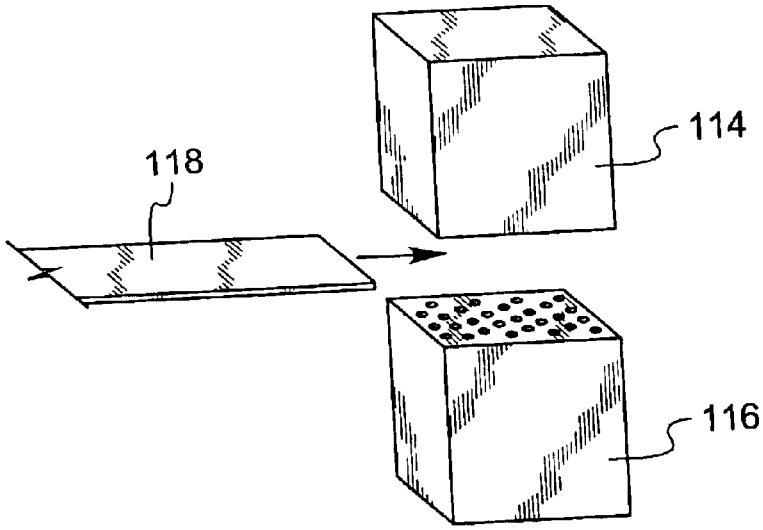
FIG. 5 is a view in perspective illustrating the forming tools that are used to form bumps in the strip.

In a preferred embodiment, a wire insertion step is included in the method practiced with the structure of FIG. 4. This is shown by the wire 122 extending from the spool 123, and a corresponding wire and spool on the opposite side that are not visible in FIG. 4. The wires are interposed between the layers of the strip as in the FIG. 1 embodiment, and are wound between the layers as in the preferred embodiment.

There are many ways to make the spacers described above. The textured wheels and the forming tools are only two ways in which such spacers can be made. Spacers of a different configuration than the preferred bumps described above can be made as will be understood by the person of ordinary skill. For example, in an alternative embodiment a strip that is to be made into a regenerator has tabs that serve as the spacers. Each tab is formed by cutting the strip along a U-shaped curve, and then pushing the free end of the portion of the strip that is within the U-shaped curve to one side along a path transverse to the plane that contains the strip. Such tabs are known in the field of regenerators.

In addition to the preferred embodiment, it is possible to insert only one wire between layers of the strip. The wire can be inserted anywhere across the width of the strip, although it is preferred that it be inserted near, and preferably directly adjacent a lateral edge.

Although the invention above is described as being for forming a wound regenerator, the invention can be used to form a wound roll from a strip with spacers where the strip is subsequently unwound and cut or otherwise formed into another configuration. For example, it is possible to reverse the rotation of the take-up spool 20 as shown in FIG. 1 and cut the strip into small plates for use, for example, in another regenerator or another structure.

While certain preferred embodiments of the present invention have been disclosed in detail, it is to be understood that various modifications may be adopted without departing from the spirit of the invention or scope of the following claims.

What is claimed is:

1. A method of producing a wound roll from an elongated strip, the method comprising:

a) deforming the strip in a plurality of discrete locations along the strip's length to form a plurality of spacers on the strip;

b) positioning at least one elongated wire on the strip;

c) winding the strip and said at least one wire around a rotatable take-up spool, thereby forming strip layers where portions of the strip are wound over previously wound portions of the strip with said at least one wire interposed between adjacent layers of the strip; and d) removing said at least one wire.

2. The method in accordance with claim 1, wherein said at least one wire is positioned on the strip near a lateral strip edge.

3. The method in accordance with claim 2, wherein said at least one wire further comprises first and second wires, and the method further comprises positioning said first wire near the lateral strip edge and positioning the second wire near a second, opposite lateral strip edge.

4. The method in accordance with claim 3, wherein the step of removing the wires further comprises pulling the wires laterally from between the strip layers.

5. The method in accordance with claim 4, wherein the wires have a diameter substantially equal to a spacer height, and wherein the spacers of each strip layer seat against an adjacent strip layer, thereby spacing the layers from one another between said wires.

6. The method in accordance with claim 5, wherein the spacers are bumps.

7. The method in accordance with claim 5, wherein the spacers are tabs.

8. A method of producing a wound roll from an elongated strip, the method comprising:

a) extending the elongated strip through a forming tool;

b) winding the elongated strip around a rotatable take-up spool downstream of the forming tool;

c) rotating the take-up spool through a predetermined angle that is a fraction of a complete rotation of the take-up spool, thereby advancing the elongated strip through the forming tool a predetermined distance that is a function of the predetermined angle, stopping the take-up spool and then actuating the forming tool to deform the strip locally to form at least one spacer on the strip;

d) repeating step c) until the take-up spool has been rotated about 360 degrees, rotating the take-up spool through the predetermined angle plus an offset angle to advance the elongated strip through the forming tool a distance that is different from the predetermined distance, stopping the take-up spool and then actuating the forming tool to deform the strip locally to form at least one spacer on the strip; and e) repeating steps c) and d) for a plurality of complete rotations of the take-up spool, thereby forming layers of the elongated strip where a portion of the elongated strip is wound around the take-up spool over a previously wound portion of the elongated strip, for inhibiting alignment of spacers on adjacent layers.

9. The method in accordance with claim 8, further comprising:

a) positioning at least one elongated wire on the strip upstream of the take-up spool and then winding the strip and said at least one wire around the take-up spool with said at least one wire interposed between adjacent layers of the strip; and b) removing said at least one wire.

10. The method in accordance with claim 9, wherein said at least one wire is positioned on the strip near a lateral strip edge.

11. The method in accordance with claim 10, wherein said at least one wire further comprises first and second wires, and the method further comprises positioning said first wire near a first lateral strip edge and positioning the second wire near a second, opposite lateral strip edge.

12. The method in accordance with claim 11, wherein the step of removing the wires further comprises pulling the wires laterally from between the strip layers.

13. The method in accordance with claim 12, wherein the wires have a diameter substantially equal to a spacer height, and wherein the spacers of each strip layer seat against an adjacent strip layer, thereby spacing the layers from one another between said wires.

14. The method in accordance with claim 13, wherein the spacers are bumps.

15. The method in accordance with claim 13, wherein the spacers are tabs.

* * * * *